US006007705A

United States Patent [19]

Greaney et al.

[11] Patent Number: 6,007,705

[45] Date of Patent: Dec. 28, 1999

[54] METHOD FOR DEMETALLATING PETROLEUM STREAMS (LAW772)

[75] Inventors: Mark Alan Greaney, Upper Black Eddy, Pa.; Paul James Polini, Rahway, N.J.

[73] Assignee: Exxon Research and Engineering Co, Florham Park, N.J.

[21] Appl. No.: 09/216,572

[22] Filed: Dec. 18, 1998

[51] Int. Cl.[6] ..... C10G 17/00

[52] U.S. Cl. ..... 208/251 R; 208/251 H; 208/87; 208/236

[58] Field of Search ..... 208/251 R, 251 H, 208/87, 236

[56] References Cited

U.S. PATENT DOCUMENTS

| | | | |
|---|---|---|---|
| 2,902,428 | 9/1959 | Kimberlin, Jr. et al. | 208/251 R |
| 3,971,713 | 7/1976 | Ellender, Jr. | 208/226 |
| 4,752,379 | 6/1988 | Delaney | 208/251 R |
| 4,773,988 | 9/1988 | Delaney | 208/251 R |
| 4,915,818 | 4/1990 | Yan | 208/251 R |
| 5,282,959 | 2/1994 | Roling et al. | 208/251 R |
| 5,626,742 | 5/1997 | Brons et al. | 208/251 R |
| 5,683,626 | 11/1997 | Sartori et al. | 252/389.62 |
| 5,746,907 | 5/1998 | Wielers et al. | 208/251 R |
| 5,817,228 | 10/1998 | Greaney et al. | 208/251 R |

FOREIGN PATENT DOCUMENTS

| | | | |
|---|---|---|---|
| WO97/08270 | 6/1997 | WIPO | C10G 19/00 |
| WO97/08271 | 6/1997 | WIPO | C10G 19/00 |
| WO97/08275 | 6/1997 | WIPO | C10G 71/00 |

OTHER PUBLICATIONS

Kalichevsky et al, Petroleum Refining With Chemicals, Elsevier Publishing Company, Chapter 4, pp. 136–183 (1956).

Collins et al, "Oxidative desulphurisation of oils via hydrogen peroxide and heteropolyanion catalysis", Journal of Molecular Catalysis A: Chemical, 117, pp. 397–403 (1997).

Gould, "Oxidative demetallization of petroleum asphaltenes and residua", Fuel, vol. 59, pp. 773–736 (Oct. 1980).

Halpern, Phase–Transfer Catalysis, vol. A19, pp. 293–298.

Branthaver, "Influence of Metal Complexes in Fossil Fuels on Industrial Operations", Chapter 12, American Chemical Society Symp. Series No. 344 (1987).

Ovalles et al, "Upgrading of Orinoco Belt crude oil and its fractions . . . ", Fuel Processing Technology 48 (1996), pp. 159–172.

*Primary Examiner*—Helane Myers
*Attorney, Agent, or Firm*—Linda M. Scuorzo

[57] ABSTRACT

The present invention relates to a process for demetallating a petroleum stream by contacting a metals-containing petroleum feed in the presence of an aqueous base selected from Group IA and IIA hydroxides and carbonates and ammonium hydroxide and carbonate and mixtures thereof, an oxygen containing gas and a phase transfer agent at a temperature of up to 180° C. for a time sufficient to produce a treated petroleum feed having a decreased metals content. The invention provides a method for enhancing the value of petroleum feeds that traditionally have limited use in refineries due to their metals, e.g., Ni and V content.

10 Claims, No Drawings

METHOD FOR DEMETALLATING PETROLEUM STREAMS (LAW772)

FIELD OF THE INVENTION

The present invention relates to a method for demetallating petroleum feedstreams.

BACKGROUND OF THE INVENTION

Petroleum streams that contain metals are typically problematic in refineries as streams because the metallic components contained therein have a negative impact on certain refinery operations. Thus, demetallation has been referred to as critical to help conversion of crude fractions (see, e.g., Branthaver, Western Research Institute in Ch. 12, "Influence of Metal Complexes in Fossil Fuels on Industrial Operations", Am. Chem. Soc. Symp. Series No. 344 (1987)).

The presence of such metals prevents more advantageous use of the petroleum stream by rendering especially the heaviest oil fractions (in which these metal containing structures concentrate) less profitable to upgrade, and when these resources are used they make catalyst replacement/disposal expensive. Current refinery technologies typically address the problem by using metal containing feedstreams as a less preferred option, and by tolerating catalyst deactivation when there are not other feedstream alternatives available.

Treatment of petroleum resids to remove metals in the presence of air and a 50% NaOH solution with strong oxidants (sodium hypochlorite and peroxyacetic acid) are disclosed in Gould (Fuel, Vol. 59, p. 733, October 1980). Gould disclosed negligible metals removal with NaOH and air and no metals removed with air alone at 100° C. Additionally, essentially no demetallation was achieved in Gould when a weak oxidizing agent was used. It was concluded that stronger oxidants than air were required.

U.S. Pat. No. 3,971,713 discloses a process for desulfurizing crude oils using solid calcium hydroxide at atmospheric pressure. Vanadium removal is also disclosed. However, the process is carried out at temperatures below about 100° F. because desulfurization decreases at higher temperatures. The addition of water had a detrimental effect on the process as well. This would suggest that the use of aqueous calcium hydroxide is precluded. This process would be of limited application for treatment of resids, which are characterized by much higher viscosities than whole crude.

By contrast there exist a body of art related to the removal of non-metals, e.g., sulfur, which use phase transfer agents but typically require the presence of a strong oxidizing agent such as $H_2O_2$ (see, e.g., Collins, et al., J. Molecular Catalysis A: Chemical 117, 397–403 (1997)). Use of the oxidant often also must be combined with additional processing steps (e.g., adsorption) in order to remove the oxygenated sulfur compounds from the treated stream. Treatment of petroleum feeds with base has been practiced to remove certain acids see, e.g., Kalichevsky and Kobe, eds., *Petroleum Refinery With Chemicals*, Elsevier Publ., 1956; Sartori, et al, International Application No. PCT/US96/13688 (Int'l. Publ. No. WO 97/08270) which discloses treatment with Group IA or IIA oxides, hydroxides or hydrates. U.S. Pat. No. 5,683,626 which discloses treatment of with tetraalkylammonium hydroxides to decrease crude acidity.

One skilled in the art would not expect that processes for removal of sulfur or naphthenic acids would be applicable to demetallation of petroleum streams because sulfur and naphthenic acids are not metals and would not be expected to behave as such.

It would be desirable to develop a process that would permit demetallation to be carried out at mild process conditions using air or oxygen rather than the stronger oxidizing agents ($H_2O_2$ and stronger) that are typically used.

SUMMARY OF THE INVENTION

The present invention provides for a method for removing metals, preferably Ni and V, from petroleum streams containing these metals. In one embodiment the process provides for a process for demetallating a petroleum stream, by contacting a metals-containing petroleum feed in the presence of an effective amount of water, a base selected from Group IA and IIA hydroxides and carbonates and ammonium hydroxide and carbonates and mixtures thereof, an oxygen containing gas and a phase transfer agent at a temperature of from 100° C. to 180° C. for a time sufficient to produce a treated petroleum feed having a decreased metals content.

The process may also be used to remove metals, such as Fe, that are more easily removed than Ni and V.

The present invention may suitably comprise, consist or consist essentially of the described elements and may be practiced in the absence of an element not disclosed.

DETAILED DESCRIPTION OF THE INVENTION

The present invention provides for a method for demetallating (particularly those typically associated with hydrocarbon species and thus hydrocarbon soluble, e.g., petroporphyrins) a metals-containing hydrocarbonaceous petroleum stream by contacting a petroleum stream (also referred to herein as a fraction, feedstream or feed) containing the metals in the presence of an effective amount of aqueous base selected from Group IA and IIA hydroxides and carbonates and ammonium hydroxide and carbonate and mixtures thereof, an oxygen-containing gas and at least one phase transfer agent at an effective temperature of from 100° C. to 180° C. to produce a treated petroleum stream or fraction having a decreased metals content. The contacting is carried out at a pressure that corresponds to the reaction temperature and is typically less than 10,000 kPa.

The oxygen containing gas is suitably an effective concentration of air or oxygen to produce demetallation under process conditions.

Bases preferred are strong bases, e.g., NaOH, KOH, ammonium hydroxide and carbonate. These may be used as an aqueous solution of sufficient strength, typically at least 20% or as a solid in the presence of an effective amount of water to produce an aqueous solution suitable to result in demetallation of a metals containing petroleum stream under process conditions.

The phase transfer agent is present in a sufficient concentration to result in a treated feed having a decreased metals content. The phase transfer agent may be miscible or immiscible with the petroleum stream to be treated. Typically, this is influenced by the length of the hydrocarbyl chain in the molecule; and these may be selected by one skilled in the art. While this may vary with the agent selected typically concentrations of 0.1 to 10 wt % are used. Examples include quaternary ammonium salts, quaternary phosphonium salts, crown ethers, and open-chain polyethers such as polyethylene glycols, and others known to those skilled in the art either supported or unsupported.

While process temperatures of from 100° C. to 180° C. are suitable, lower temperatures of less than 150° C., less than 120° C. can be used depending on the nature of the feed and phase transfer agent used.

The metallic components that may be treated include Ni and V species, as these are typically present in petroleum streams. Transition metals such as Ni and V are often found, for example, in porphyrin and porphyrin-like complexes or structures, and are abundant in heavy petroleum fractions. In these feeds such metal species tend to be found in non-water soluble or water-immiscible structures. However, hydrocarbon soluble metals components of petroleum streams traditionally have been difficult to treat and have required the use of strong oxidizing agents or application of high temperatures and/or high pressures, particularly when mild oxidizing agents have been used. Petroleum streams are complex mixtures of many different types of reactive and unreactive species. As such the ability to successfully treat particular components of petroleum streams or fractions is not readily predictable from the reactivity of and success in treating pure components.

The process of this invention also may be applied to the removal of metals that are more easily removed than Ni and V, such as Fe. However, since other processing options are available for removal of such other metals, the process is most advantageous for removal of the metals Ni, V, as these are typically more costly to remove. A benefit of the process of the present invention is in its ability to remove metals contained in typically non-water extractable metals containing moieties.

Examples of Ni and V metal-containing petroleum streams or fractions that may be treated according to the process of the present invention are metal containing carbonaceous and hydrocarbonaceous petroleum streams of fossil fuels such as crude oils and bituminous, as well as processed/distilled streams (distillation residues) such as coker oils, atmospheric and vacuum resids, fluid catalytic cracker feeds, metal containing deasphalted oils and resins, processed resids and heavy oils (heavy crudes) as these typically have a high metals content. These are typically 650° F.+ (343° C.+) fractions.

The feed to be demetallated can have a range of metals content. The average vanadium in the feed is typically about 5 ppm to 2,000 ppm, preferably about 20 to 1,000 ppm, by weight, most preferably about 20 to 100 ppm. The average nickel content in the starting feed is typically about 2 to 500 ppm, preferably about 2 to 250 ppm by weight, most preferably about 2 to 100 ppm. For example, a Heavy Arab crude may have a typical nickel content of 8 ppm and a vanadium content of 50 ppm by weight. However, any level of nickel and/or vanadium may be treated according to the present invention.

The metals containing petroleum feed to be treated preferably should be in a liquid or fluid state at process conditions. This may be accomplished by heating the material or by treatment with a suitable solvent as needed.

Preferably the oil droplets should be of sufficient mean droplet size to enable the metals containing components to achieve intimate contact with the aqueous phase. Oil droplet particles having a mean droplet size of about 1 to 100 microns (diameter) should be typical, and 1 to 20 are preferable; larger droplet sizes of greater than 100 microns are not preferable.

Desirably the process should be carried out for a time and at conditions within the ranges disclosed sufficient to achieve a decrease, preferably a maximum decrease, in metals content of the metals containing petroleum stream. Contact can be achieved, e.g., by vigorous homogenization for the components of the mixture, particularly the petroleum feed, phase transfer agent, oxygen and base.

Gas mixing with petroleum stream can be accomplished using means known in the art, e.g., in high shear mixers or through the use of gas spargers. Gas bubble size can be adjusted to attain optimum performance in the reactor. Ideally, dispersed gas will comprise from about 5 to 50 vol % of the gas-liquid mixture in the reactor. Desirably a thin film of oil is brought into contact with base, phase transfer agent and oxygen to effect removal of metals.

Reaction temperatures will vary with the particular petroleum stream due to its viscosity. However, temperatures may suitably range from about ambient to about 180° C. and corresponding pressures of from 0 kPa to 10,000 kPa. An increase in temperature may be used to facilitate removal of metal species. Within the process conditions disclosed a liquid or fluid phase or medium should be maintained.

Following demetallation, the product petroleum stream contains a decreased content of metals, e.g., Ni and/or V and/or Fe content. While the actual amount removed will vary according to the starting feed, on average, vanadium levels of not more than about 15 ppm by weight, preferably less than about 4 ppm and on average nickel levels of less than about 10 ppm, preferably less than about 2 ppm can be achieved. Greater than 30 percent by weight of the total vanadium and nickel can thereby be removed.

Optionally, a metals-recovery step may be added, as needed to recover the metals from the aqueous phase. The nature of any such step(s) depends on the nature of the bed/reactor, solubility or insolubility of the metals in the aqueous phase and the nature and amount of the phase transfer agent and may be chosen by one skilled in the art.

The metal contaminant-decreased (e.g., upgraded) product may be used in refining operations that are adversely affected by higher levels of metals, for example fluid catalytic cracking or hydroprocessing, or such a product can be blended with other streams of higher or lower metals content to obtain a desired level of metallic contaminants.

A benefit to the present invention is that the process may be operated under mild temperatures and pressures and mild oxidizing conditions resulting in a minimization of undesirable side reactions and an enhancement of yield also may be achieved as needed.

The invention may be demonstrated with reference to the following examples:

EXAMPLE 1

One hundred grams of a vacuum pipestill residuum was combined with an aqueous solution consisting of 400 grams of water, 193 grams of sodium hydroxide, 50 grams of 40 wt % tetrabutyl ammonium hydroxide (TBAOH) and 1 ml of Triton-x-100 surfactant. This mixture was subjected to homogenization/dispersion in a one liter glass flask using a Beckman Model 300 Homogenizer, fitted with a standard generator with saw teeth. The glass reservoir was heated with a heating mantle to 100° C. The residuum phase was isolated by addition of toluene to the sample followed by centrifugation. It was transferred to a hot plate and swept with nitrogen to speed evaporation of toluene. The metals content of the residuum samples were analyzed by Inductively Coupled Plasma (ICP). The initial residuum contained 29.6 ppm vanadium and 16.5 ppm nickel. The product resid contained 2.9 ppm vanadium and 6.3 ppm nickel.

EXAMPLE 2

One hundred grams of a deasphalted vacuum resid was combined with 48 grams of powdered potassium hydroxide (Fluka), 25 grams of polyethyleneglycol 400 (Aldrich) and 10 ml of distilled water. This mixture was subjected to homogenization/dispersion in a five hundred milliliter glass beaker using a Beckman Model 300 Homogenizer, fitted with a standard generator with saw teeth. The glass beaker was heated with a heating mantle to 100° C. The resid phase was isolated by addition of toluene to the sample followed by separation in a separatory funnel. The organic phase was extracted three times with distilled water. The vanadium content of the residuum was analyzed by Electron Spin Resonance (ESR). The initial residuum contained 11.9 ppm vanadium. The product resid contained 9.0 ppm vanadium.

Example 6 (Comparative)

Water Only

The same procedure as in Example 1 was followed, except that the aqueous phase consisted of only distilled water with no sodium hydroxide, no tetrabutylammonium hydroxide and no surfactant. The product residuum contained 27.8 ppm vanadium and 16.9 ppm nickel.

Example 7 (Comparative)

Inert Atmosphere—No Air/Oxygen

The same procedure as in Example 1 was followed, except that instead of conducting the reaction under an atmosphere of air, the reaction was run under an inert argon atmosphere. Prior to homogenization, the solution was purged with argon for one hour to displace all dissolved oxygen. The product residuum contained 28.0 ppm vanadium and 17.4 ppm nickel.

Example 8 (Comparative)

No Tetrabutylammonium Hydroxide

The same procedure as in Example 1 was followed, except that no tetrabutylammonium hydroxide was added. The product residuum contained 21.9 ppm vanadium and 18 ppm nickel.

Example 9 (Comparative)

No Surfactant

The same procedure as in Example 1 was followed, except that no Triton-x-100 surfactant was added. The product residuum contained 1.3 ppm vanadium and 3.7 ppm nickel.

What is claimed is:

1. A process for demetallating a petroleum stream, comprising:

contacting a metals-containing petroleum feed in the presence of an effective aqueous base selected from Group IA and IIA hydroxides and carbonates and ammonium hydroxide and carbonates and mixtures thereof, an oxygen containing gas and a phase transfer agent at a temperature of from 100° C. to 180° C. for a time sufficient to produce a treated petroleum feed having a decreased metals content.

2. The process of claim 1 wherein the base is selected from NaOH and KOH and mixtures thereof.

3. The process of claim 1 wherein the temperature is up to 150° C.

4. The process of claim 1 wherein the temperature is up to about 120° C.

5. The process of claim 1 wherein the phase transfer agent is selected from tetraalkylammonium salts, quaternary phosphonium salts, crown ethers and open-chain polyethers.

6. The process of claim 1 wherein the phase transfer agent is selected from tetraalkylammonium hydroxide and polyethylene glycols and tetraalkylammonium salts.

7. The process of claim 1 wherein the oxygen containing gas is selected from air and oxygen.

8. The process of claim 1 wherein the base is present in an amount of at least 20 wt %.

9. The process of claim 1 wherein the phase transfer agent is present in an amount of 0.1 to 10 wt %.

10. The process of claim 1 wherein the metals-containing feed has a mean droplet size of 1–100 microns.

* * * * *